US005516311A

United States Patent [19]

Maejima

[11] Patent Number: 5,516,311

[45] Date of Patent: May 14, 1996

[54] ELECTRIC CONNECTOR TERMINAL

[75] Inventor: Toshiro Maejima, Shizuoka, Japan

[73] Assignee: Yazaki Corporation, Tokyo, Japan

[21] Appl. No.: 305,987

[22] Filed: Sep. 19, 1994

[30] Foreign Application Priority Data

Sep. 17, 1993 [JP] Japan ..... 5-231857

[51] Int. Cl.[6] ..... H01R 4/18

[52] U.S. Cl. ..... 439/877

[58] Field of Search ..... 439/595, 877, 439/879–882

[56] References Cited

U.S. PATENT DOCUMENTS

| | | | |
|---|---|---|---|
| 4,124,264 | 11/1978 | Kato et al. | 439/595 |
| 4,461,911 | 2/1987 | Pavlak et al. | 439/877 |
| 4,891,021 | 1/1990 | Hayes et al. | 439/877 |

FOREIGN PATENT DOCUMENTS 55-7235 1/1980 Japan .

55-139772 10/1980 Japan .

*Primary Examiner*—Gary F. Paumen

*Attorney, Agent, or Firm*—Wigman, Cohen, Leitner & Myers

[57] ABSTRACT

An electric connector terminal inserted into a terminal accommodating chamber of a connector housing, comprises: a first engagement portion (23) for engagement with a mating terminal; a wire conductor clamping portion (19) formed to the rear of the first engagement portion; a second engagement portion (13) formed at the rear end of the first engagement portion for engagement with a lance formed in the terminal accommodating chamber, for fixing the terminal to the connector housing; and in particular a prevention wall (29, 43) formed between the lance engage portion and the wire conductor clamping portion, for imprisoning the wire ends which might otherwise interfere with bare wire conductor ends projecting from the wire conductor clamping portion and the lance of the connector housing when the connector terminal is inserted into the connector housing. The presence of the prevention wall allows the terminal to be securely inserted into the connector housing.

5 Claims, 6 Drawing Sheets

ELECTRIC CONNECTOR TERMINAL

BACKGROUND OF THE INVENTION

1. Technical Field

The present invention relates to an electric connector terminal formed with a clamping portion, which is inserted into and held by a connector housing.

2. Description of the Related Art

In general, the electric connector terminal housed in a connector housing is formed with an engage portion engaged with a mated terminal at one (front) end thereof and with a wire clamping portion for clamping wire at the other (rear) end thereof. On the other hand, the connector housing is formed with a terminal accommodating chamber having a lance projecting obliquely in the chamber to fix the terminal to the connector housing. Further, the terminal is formed with a lance engage portion between the engage portion and the wire clamping portion.

When the terminal is inserted into the connector housing from the read end of the connector housing, since the lance projecting obliquely in the connector housing is pushed away by the engage portion of the terminal, the terminal can be inserted into the connector housing. Further, when the lance end of the connector housing is engaged with the lance engage portion of the terminal, the terminal is fixed firmly to the connector housing.

In the above-mentioned connector, under the normal conditions, the terminal inserted into the connector housing can be engaged with the lance of the connector housing in the terminal accommodating chamber. However, when the wire conductor is not well clamped to the terminal; that is, when the wire conductor end is dislocated or deformed from the normal position upward and toward the lance engage portion, there exists a problem in that the wire conductor interferes with the lance and thereby the terminal cannot be inserted into the connector housing securely and firmly.

Further, in Japanese Published Unexamined (Kokai) Utility Mode Application No. 55-7235 disclosed a connector provided with an area for covering an end surface of wire conductor from the outside air, on the front side of the wire clamping portion. In this connector, however, when the wire conductor is clamped under the condition that the wire conductor end extends beyond the covering area, since the wire conductor end is dislocated or deformed from the normal position toward the lance engage portion, there exists a similar problem in that the terminal cannot be inserted into the connector housing securely and firmly.

SUMMARY OF THE INVENTION

Accordingly, it is the object of the present invention to provide an electric connector terminal which can prevent the wire conductor end from being dislocated or deformed from the wire clamping portion toward the lance engage portion, in order that the terminal can be held in the connector housing securely and firmly.

To achieve the above-mentioned object, the present invention provides an electric connector terminal inserted into a terminal accommodating chamber of a connector housing, comprising: an engage portion engaged with a mated terminal; a wire conductor clamping portion formed in rear of the engage portion; a lance engage portion formed at rear end of the engage portion and engaged with a lance formed in the terminal accommodating chamber, for fixing the terminal to the connector housing; and a prevention wall formed between the lance engage portion and the wire conductor clamping portion, for preventing interference between wire conductor projecting from the wire conductor clamping portion and the lance of the connector housing when the connector terminal is inserted into the connector housing.

In the electric connector terminal according to the present invention, even if the wire conductor end extends from the wire conductor clamping portion, since the prevention wall can prevent the wire conductor end from being dislocated or deformed from the wire clamping portion toward the lance engage portion beyond the predetermined position, it is possible to always insert the terminal into the connector housing securely and firmly.

DETAILED DESCRIPTION OF THE PREFERRED EMBODIMENTS

[First embodiment]

Figure 1:
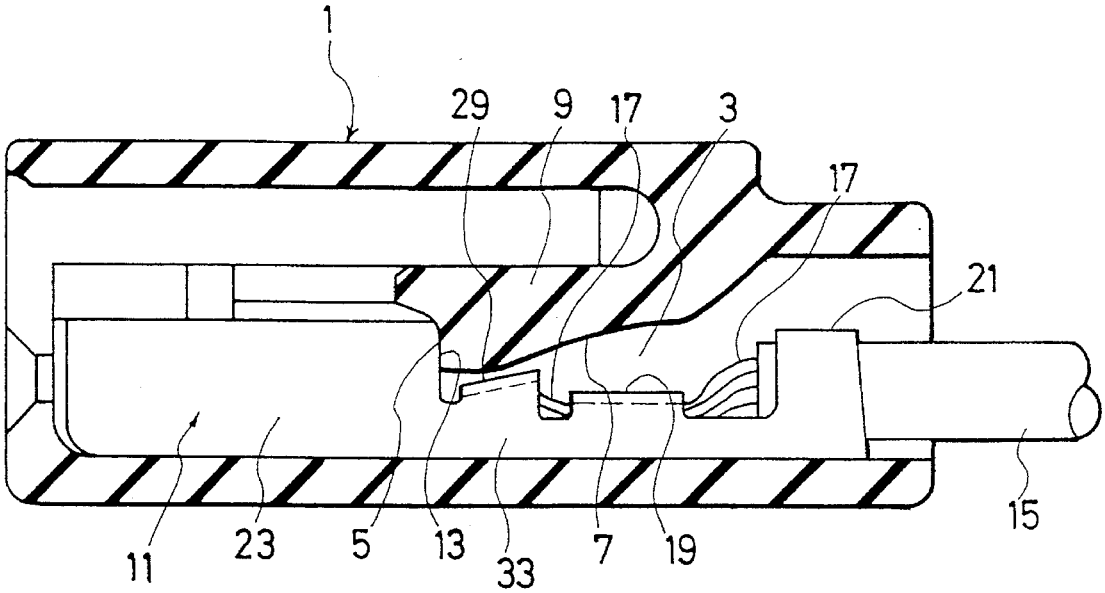
FIG. 1 is a cross-sectional view showing a first embodiment of the electric connector terminal according to the present invention, in which the terminal is inserted into a connector housing.

FIG. 1 is a cross-sectional view showing a first embodiment of the electric connector terminal according to the present invention, in which an electric connector terminal 11 is housed in a connector housing 1. The connector housing 1 is formed with a lance 9 in a terminal accommodating chamber 3 of the connector housing 1. The lance 9 is formed with an engagement claw 5 and a guide surface 7 along which a connector terminal 11 is inserted into the connector housing 1.

On the other hand, the connector terminal 11 is formed with a covered wire 15 clamping portion 21, a wire conductor clamping portion 19, a prevention wall 29, and an engagement portion 23, extending from the rear side (the right side in FIG. 1) to the front side (the left side) thereof. The covered wire 15 clamping portion 21 clamps a covered wire 15 having wire conductor. The wire conductor clamping portion 19 clamps the bare wire conductor 17 of the covered wire 15. The engagement portion 23 is engaged with a mated terminal (not shown). Further, a lance engagement portion 13 of the engagement portion 23 is engaged with the engagement claw 5 of the lance 9 of the connector housing 1 when the terminal 11 is inserted into the connector housing 1. Here, the feature of the present invention is to form the prevention wall 29 between the engagement portion 23 and the wire conductor clamping portion 19, to prevent wire conductor end from being dislocated or deformed from the wire clamping portion 19 toward the engagement portion 23 beyond the normal position.

Figure 2:
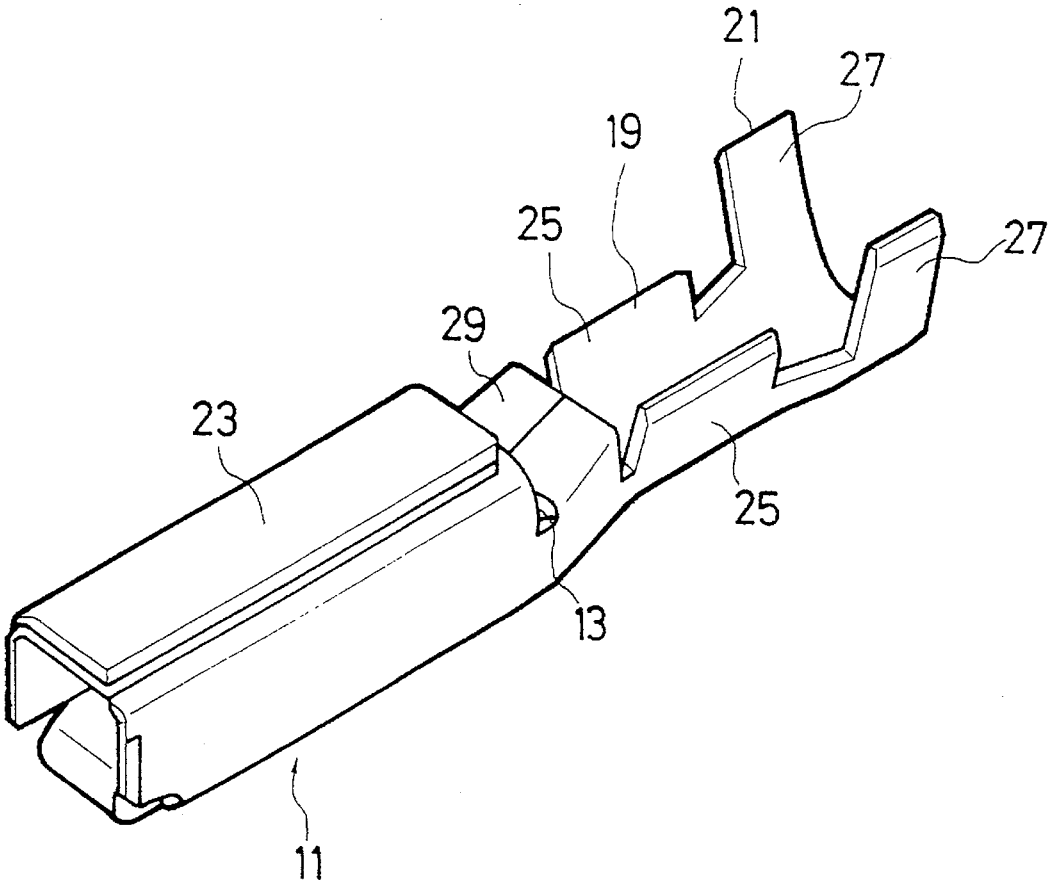
FIG. 2 is a perspective view showing the connector terminal of the first embodiment shown in FIG. 1, in which the wire is not yet clamped.
Figure 3:
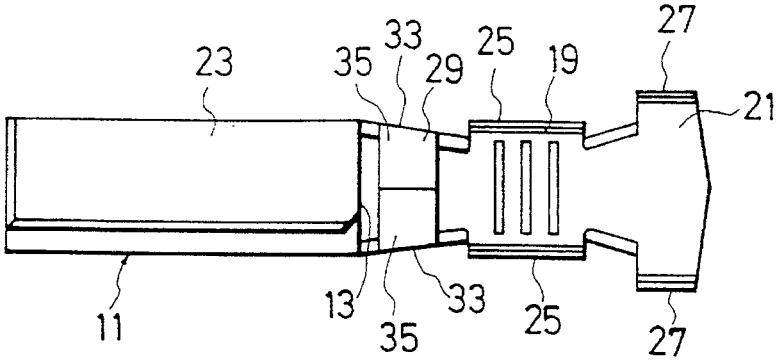
FIG. 3 is a plane view showing the connector terminal of the first embodiment shown in FIG. 1, in which the wire is also not yet clamped.
Figure 4:
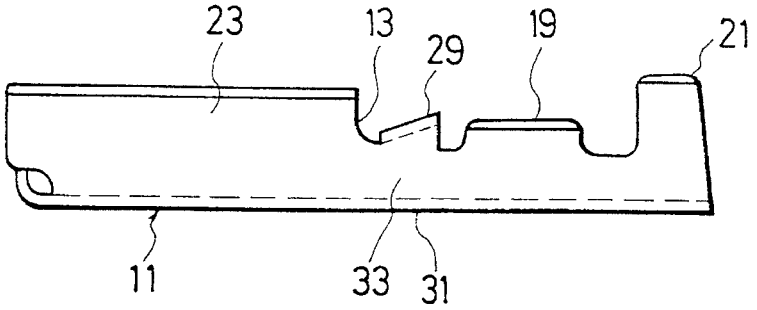
FIG. 4 is a side view showing the connector terminal of the first embodiment shown in FIG. 1, in which the wire is also not yet clamped.

In more detail, FIGS. 2, 3, and 4 show the connector terminal 11 of the first embodiment, in which the covered wire 15 is not yet clamped. The engage portion 23 of the terminal 11 is of elastic female type. The wire conductor clamping portion 19 is composed of a pair of U-shape upward-opened clamping side walls 25. The covered wire clamping portion 21 is similarly composed of a pair of U-shape upward-opened clamping side walls 27. The lance engage portion 13 is formed at the rear end of the engage portion 23.

In particular, in this first embodiment, the terminal 11 is formed with the prevention wall 29 between the lance engage portion 13 and the wire conductor clamping portion 19, for prevention of the bare wire conductor 17 from being dislocated or deformed from the normal position; that is, form the wire conductor clamping portion 19 toward the lance engage portion 13. This is because when the bar wire conductor 17 extends to the lance engage portion 13 beyond the predetermined position, since the wire conductor end interferes with the engage claw 5 of the lance 9, the terminal 11 cannot be engaged firmly with the connector housing 1.

This prevention wall 29 is formed in such a way as to cover a pair of U-shaped passage between the lance engage portion 13 and the wire conductor clamping portion 19 and further as to extend being sloped upward (or inward in the connector housing) from the lance engage portion 13 to the wire conductor clamping portion 19 along the slope of the guide surface 7 of the lance 9 formed in the connector housing 1.

With reference to FIGS. 3 and 4, the rear side of the engage portion 23 is formed into a U-shaped cross section composed of a bottom wall 31 (a link bottom portion for linking the lance engage portion 13 with the wire conductor clamping portion 19) and two side walls 33 formed extending upward from the link bottom portion 31. Therefore, the prevention wall 29 can be formed by extending the two side walls 33 upward and further by bending the upper ends of the extended side walls 33 inward, so as to form two wire-conductor covering walls 35.

Figure 5:
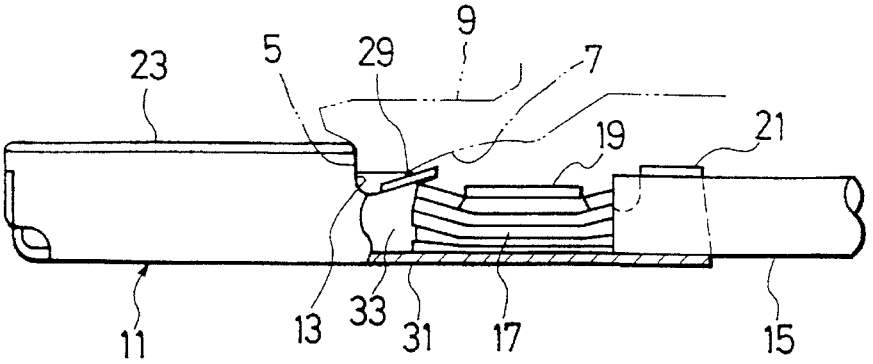
FIG. 5 is a side view showing the connector terminal of the first embodiment shown in FIG. 1 in relation to the lance of the connector housing, in which the wire has been clamped.

In assembly, as shown in FIG. 5, the wire conductor 17 of the covered wire 15 is inserted to the wire conductor clamping portion 19 from the rear side, and then clamped. Under these conditions, since the free end of the wire conductor 17 is brought into contact with the inner surface of the prevention wall 29, it is possible to prevent the wire conductor 17 from being dislocated or deformed upward (inward in the housing) and toward the lance engage portion 13. In particular, since the prevention wall 29 is sloped downward (outward in the housing) from the rear side to the front side of the terminal 11, the wire conductor 17 can be guided securely downward (outward in the housing).

After the wire conductor 17 has been clamped by the wire conductor clamping portion 19 and further the covered wire 15 has been clamped by the wire clamping portion 21, as shown in FIG. 5, the terminal 11 is inserted into the connector housing 1 from the rear side (from the right side in FIG. 1). When being inserted into the connector housing 1, since the engage portion 23 of the terminal 11 is brought into pressure contact with the guide surface 7 of the lance 9 of the connector housing 1, the lance 9 is forcedly deformed inward elastically, so that the engage claw 5 of the lance 9 of the connector housing 1 can be engaged with the lance engage portion 13 formed at the rear end of the engage portion 23. As a result, the terminal 11 can be held at a predetermined position firmly in the connector housing 1.

As described above, in the electric connector terminal 11 of the present invention, when the terminal 11 is inserted into the connector housing 1 and the lance engage portion 13 of the terminal 11 is engaged with the lance 9 of the connector housing 1, since the inner end of the bare wire conductor 17 will not interfere with the lance 9 of the connector housing 1, it is possible to allow the terminal 11 to be securely engaged with the lance 9 of the connector housing 1.

In addition, since the upper (inward in the housing) wall of the prevention wall 29 is sloped along the slope of the guide surface 7 of the lance 9, it is possible to securely form a narrow sloped space in the connector housing 1 for making the best use of the lance engage portion 13, so that the lance engage portion 13 of the terminal 11 can be securely engaged with the engage claw 5 of the lance 9 of the connector housing 1, without causing any interference between the lance 9 (the housing 1) and the prevention wall 29 (the terminal 11).

In addition, since the prevention wall 29 can be formed by simply bending the upper ends of the two side walls 33 of the terminal 11 inward, it is possible to form the prevention wall 29 simultaneously when the clamping side walls 25 of the wire conductor clamping portion 19 are bent for clamping the wire conductor 17 to the terminal 11.

[Second embodiment]

Figure 6:
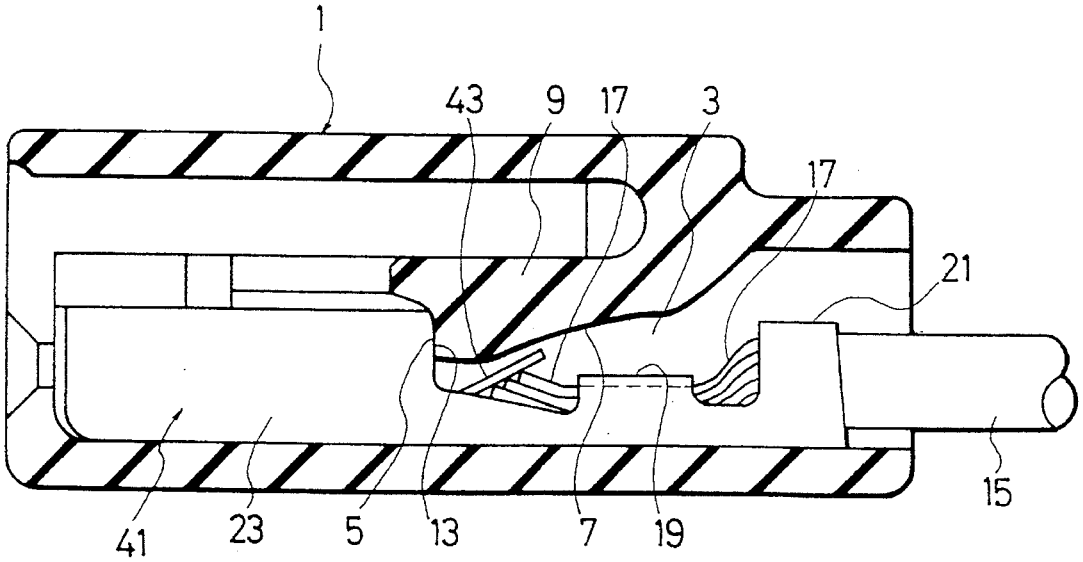
FIG. 6 is a cross-sectional view showing a second embodiment of the electric connector terminal according to the present invention, in which the terminal is inserted into a connector housing.
Figure 7:
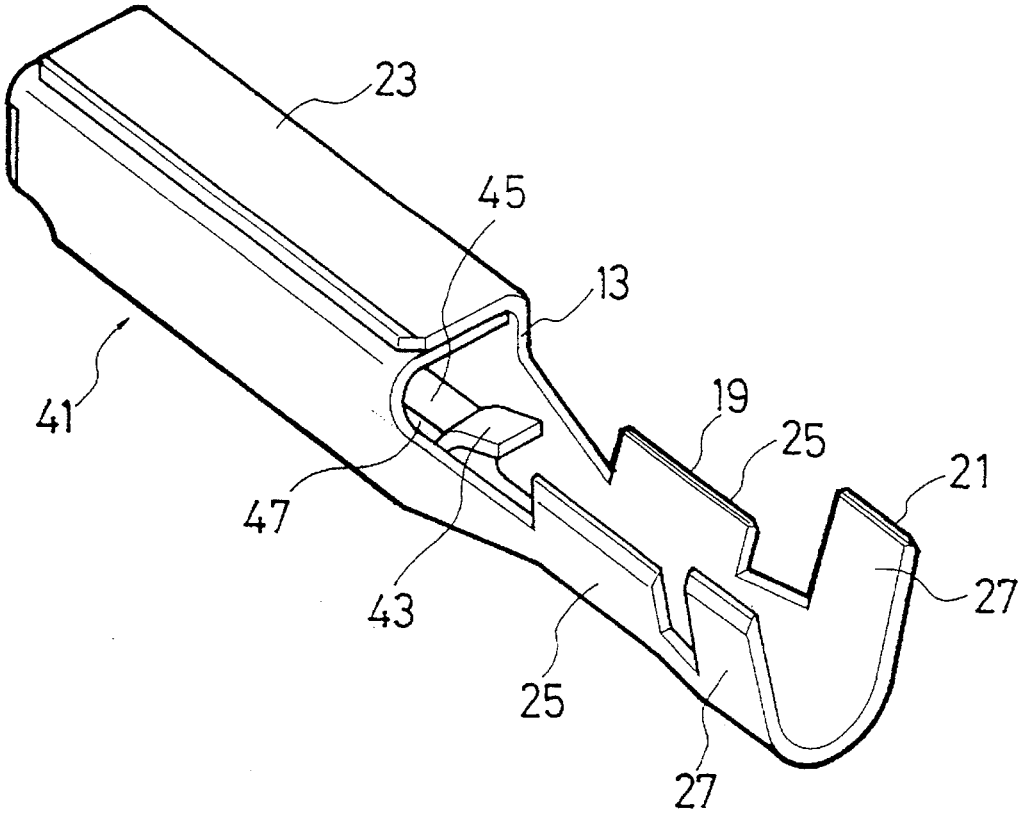
FIG. 7 is a perspective view showing the connector terminal of the second embodiment shown in FIG. 6, in which the wire is not yet clamped.
Figure 8:
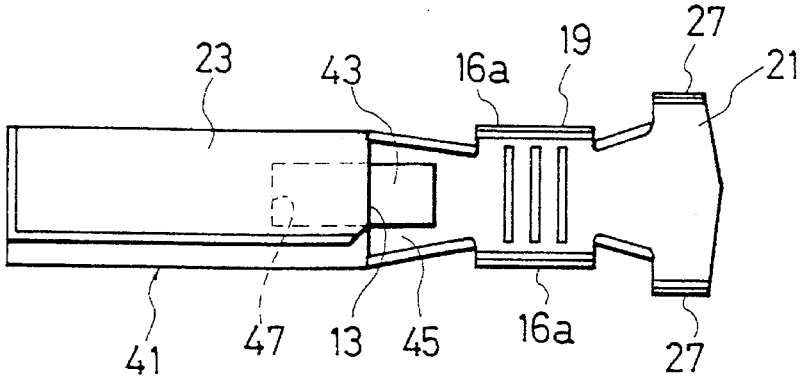
FIG. 8 is a plane view showing the connector terminal of the second embodiment shown in FIG. 6, in which the wire is also not yet clamped.
Figure 9:
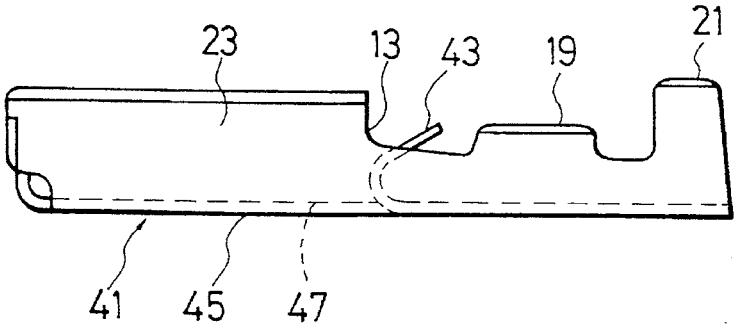
FIG. 9 is a side view showing the connector terminal of the second embodiment shown in FIG. 6, in which the wire is also not yet clamped.
Figure 10:
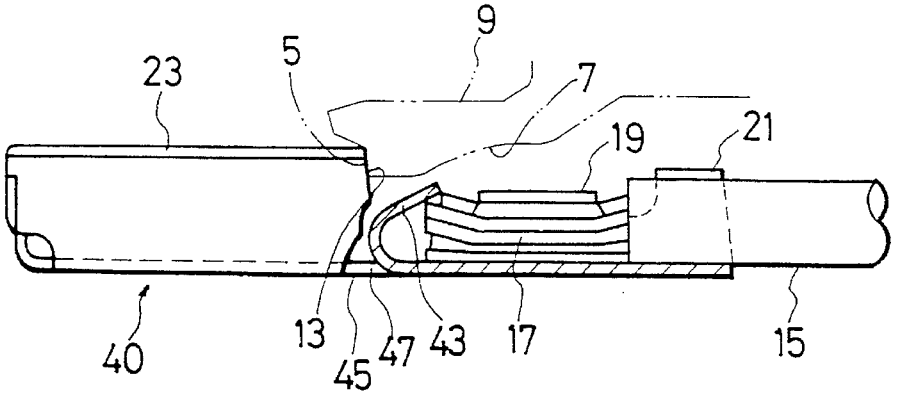
FIG. 10 is a side view showing the connector terminal of the second embodiment shown in FIG. 6 in relation to the lance of the connector housing, in which the wire has been clamped.

FIG. 6 is a cross-sectional view showing a second embodiment of the electric terminal according to the present invention, in which an electric connector terminal 41 is housed in a connector housing 1. This second embodiment is the same as with the case of the first embodiment, except the prevention wall. FIGS. 7, 8 and 9 show the electric connector terminal 41, in which the covered wire 15 is not yet clamped thereto. FIG. 10 shows the electric connector terminal 41, in which the covered wire 15 has been clamped thereto. The structural features and functional effects of this second embodiment are substantially the same as with the case of the first embodiment previously described, except the prevention wall. Therefore, the same reference numerals have been retained for similar parts which have the same functions, without repeating any detailed description thereof.

In this second embodiment, the prevention wall 43 is formed by bending a tongue piece formed in the bottom wall 45 (a link bottom portion for linking the lance engage portion 13 with the wire conductor clamping portion 19) in such a way as to first raise the formed tongue piece upward and then bend the raised tongue toward the wire conductor clamping portion 19. Therefore, the prevention wall 43 can extend over a pair of U-shaped passage between the lance engage portion 13 and the wire conductor clamping portion 19, being sloped upward (inward in the housing) from the lance engage portion 13 to the wire conductor clamping portion 19 along the slope of the guide surface 7 of the lance 9 formed in the connector housing 1. Here, the tongue piece can be formed by cutting the bottom surface 45 into a U-shape so as to leave the connection portion on the side of the wire conductor clamping portion 19. In the same way as with the case of the first embodiment, as shown in FIG. 10, when the bare wire conductor 17 of the covered wire 15 is inserted to the wire conductor clamping portion 19 from the rear side, since the free end of the wire conductor 17 is brought into contact with the inner surface of the prevention wall 43, it is possible to prevent the wire conductor 17 from being dislocated or deformed upward and toward the lance engage portion 13 beyond the predetermined position, without causing any interference between the wire conductor 17 and the lance 9 of the connector housing 1 when the terminal 11 is inserted into the connector housing 1, so that the terminal 11 can be held securely in position by the lance 9 of the connector housing 1.

In the second embodiment, since the prevention wall 43 can be formed by simply bending the tongue piece formed at the bottom wall 45 of the terminal 11, it is possible to form the prevention wall 43 simultaneously when the engage portion 23 is bent.

In the above-mentioned first and second embodiments, although the female type engage portion 23 has been explained by way of example, without being limited only thereto, it is of course possible to apply the present invention to the connector terminal of male type.

As described above, in the electric connector terminal according to the present invention, since the dislocation or deformation of the bare wire conductor 17 of the covered wire 15 toward the lance engage portion 13 beyond the normal position can be prevented securely by the presence of the prevention wall 29 or 43, it is possible to firmly engage the terminal 1 with the connector housing 1 via the lance 9 of the connector housing 1.

Further, in the first embodiment, since the prevention wall 29 can be formed simultaneously when the wire conductor clamping portion 19 is bent, the prevention wall 29 can be manufactured easily. Further, in the second embodiment, since the prevention wall 43 can be formed simultaneously when the engage portion 23 is formed, the prevention wall 43 can be manufactured easily.

What is claimed is:

1. An electric connector terminal inserted into a terminal accommodating chamber of a connector housing, comprising:

first engagement portion adapted for coupling with a mating terminal;

a wire conductor clamping portion formed rearward of said engagement portion, adapted for clamping a portion of a wire conductor near the end thereof;

a second engaging portion formed at a rear end of said first engagement portion and adapted for engagement with a lance formed in the terminal accommodating chamber, adapted for securing the terminal against withdrawal from the connector housing;

means for imprisoning stray ends of said wire conductor extending beyond said clamping portion, comprising a wire end movement prevention wall formed between said second engaging portion and said wire conductor clamping portion to lie over the stray ends to prevent upward movement thereof toward the lance.

2. The electric connector terminal of claim 1, further comprising:

a link bottom wall portion for linking said lance engaging portion with said wire conductor clamping portion; and a pair of side walls formed extending upwardly from said link bottom wall portion, wherein said prevention wall is formed by bending upper ends of said side walls inwardly.

3. The electric connector terminal of claim 2, wherein said prevention wall is formed being sloped upwardly from said lance engaging portion to said wire conductor clamping portion.

4. The electric connector terminal of claim 1, wherein said prevention wall slopes upwardly from said lance engaging portion to said wire conductor clamping portion.

5. The electric connector terminal of claim 1, wherein said prevention wall is formed by raising a tongue piece formed in said wire conductor clamping portion.

* * * * *

UNITED STATES PATENT AND TRADEMARK OFFICE

CERTIFICATE OF CORRECTION

PATENT NO. : 5,516,311
DATED : May 14, 1996
INVENTOR(S) : Toshiro Maejima

It is certified that error appears in the above-indentified patent and that said Letters Patent is hereby corrected as shown below:

ON THE TITLE PAGE:

Correct the number of the second U.S. Patent Document to read "4,641,911"

Item [56] References Cited

U.S. PATENT DOCUMENTS

| | | | |
|---|---|---|---|
| 4,124,264 | 11/1978 | Kato et al. | 439/595 |
| 4,641,911 | 2/1987 | Pavlak et al. | 439/877 |
| 4,891,021 | 1/1990 | Hayes et al. | 439/877 |

Signed and Sealed this

Sixteenth Day of December, 1997

*Attest:*

*Attesting Officer*

BRUCE LEHMAN

*Commissioner of Patents and Trademarks*